US007360719B1

(12) United States Patent
Emmons et al.

(10) Patent No.: US 7,360,719 B1
(45) Date of Patent: Apr. 22, 2008

(54) APPARATUS FOR APPLYING LOOSE FILL INSULATION

(76) Inventors: Kirk Alan Emmons, 1546 Norwood Ave., El Dorado, KS (US) 67042; Timothy Sha Vanderford, 1237 W. 1st Ave., El Dorado, KS (US) 67042

( * ) Notice: Subject to any disclaimer, the term of this patent is extended or adjusted under 35 U.S.C. 154(b) by 108 days.

(21) Appl. No.: 11/413,854

(22) Filed: Apr. 29, 2006

Related U.S. Application Data

(60) Provisional application No. 60/676,663, filed on Apr. 29, 2005.

(51) Int. Cl.
*B05B 9/04* (2006.01)

(52) U.S. Cl. ..... 239/332; 239/407; 239/333; 406/39; 406/96

(58) Field of Classification Search ..... 239/332, 239/331, 330, 329, 302, 106, 407; 406/38, 406/39, 96, 98, 99, 104, 103; 366/272
See application file for complete search history.

(56) References Cited

U.S. PATENT DOCUMENTS 2,688,388 A * 9/1954 Gill, Jr. ..... 477/87
3,040,992 A * 6/1962 Wiegand ..... 239/414
3,083,913 A * 4/1963 Coffman et al. ..... 239/150
4,176,793 A * 12/1979 Heinrich ..... 239/407
4,376,512 A * 3/1983 Kistner ..... 239/106
4,850,536 A * 7/1989 Teranishi et al. ..... 239/332
5,217,160 A * 6/1993 Lopes ..... 239/8
5,338,917 A * 8/1994 Stuart et al. ..... 219/137.63
5,403,128 A * 4/1995 Thomas ..... 406/39
5,421,520 A * 6/1995 Simonette et al. ..... 239/525
RE39,249 E * 8/2006 Link, Jr. ..... 141/231
7,144,203 B2 * 12/2006 Gerber ..... 406/14
2007/0075099 A1 * 4/2007 Hornsby et al. ..... 222/333

* cited by examiner

*Primary Examiner*—Kevin Shaver
*Assistant Examiner*—Trevor McGraw
(74) *Attorney, Agent, or Firm*—Robert O. Blinn

(57) ABSTRACT

An improved apparatus for applying loose fill insulation generally includes an insulation feed portion and an insulation gun. The insulation feed portion is driven by a motor which is controlled by a clutch and a clutch control circuit. An insulation gun is mounted to a hose which communicates with the insulation feed portion. A switch mounted on the gun opens and closes the clutch control circuit. When the switch is closed, the clutch is engaged and air blown insulation is supplied to the gun. When the switch is open, the clutch is disengaged and air blown insulation is not supplied to the gun.

5 Claims, 11 Drawing Sheets

APPARATUS FOR APPLYING LOOSE FILL INSULATION

CROSS REFERENCES TO RELATED APPLICATIONS

This application claims the benefit of U.S. Provisional Patent Application No. 60/676,663 filed Apr. 29, 2005.

FIELD OF THE INVENTION

This invention relates to an apparatus for delivering and distributing loose fill insulation into an insulation space.

BACKGROUND OF THE INVENTION

Systems for applying loose fill insulation have typically included an insulation hopper and insulation feed device for feeding loose fill insulation material to an air box, a blower for forcing pressurized air into the air box and an insulation hose for conveying an air stream containing loose fill insulation material to an insulation space. A significant shortcoming of present loose fill insulation systems is that they lack an ergonomically adapted means for aiming and controlling the flow of insulation. Moreover, present systems lack a means for shutting off the system when insulation is not required by an operator who is applying the insulation. Accordingly, a need exists for an air blown insulation system including a means for aiming the flow of insulation and for providing a high degree of control over the system for an operator who is applying insulation at an insulation space.

BRIEF DESCRIPTION OF THE INVENTION

In a first embodiment of the present invention the aforementioned needs are addressed by an improved system for the pneumatic delivery of insulation. The first embodiment of the improved system generally includes an insulation feed portion and an insulation gun. The insulation feed portion generally includes a motor, a blower, an air box, an insulation hopper and an insulation feed device. The motor drives the blower through a blower clutch which may be engaged or disengaged by opening or closing a clutch control circuit. The blower is connected to the air box via an air duct. The insulation feed device feeds loose fill insulation into the air box. The insulation feed device is preferably arranged in the system such that it operates when the blower is running. An insulation hose is attached to the air box to carry a stream of air and insulation from the air box to an insulation space. In the improved system, an insulation gun is mounted to the distal end of the insulation hose. The insulation gun includes a hollow barrel portion and a handle portion. The hollow barrel portion connects with the distal end of the insulation hose. The handle portion further includes a switch connected in the clutch control circuit. The switch is preferably biased in an open position which causes the blower clutch to be disengaged. When the switch is in the closed position, the clutch control circuit is closed and the clutch is engaged which activates the blower. The switch is preferably located on the handle portion such that when an operator is not holding the handle portion, the switch is open and the clutch is disengaged.

A second embodiment of the present invention also includes a motorized blower, an insulation hopper, a insulation feed device and an air box. The second embodiment system is similar to the first embodiment system with the exceptions that a second clutch is interposed between the motor and the insulation feed device and a second control circuit is added to control the second clutch. Accordingly, in the second embodiment system, the blower control clutch is referred to as the first clutch and the circuit that controls the first clutch is referred to as the first control circuit. When the second control circuit is closed, the second clutch is engaged and the insulation feed device is activated. When the second control circuit is open, the insulation feed clutch is disengaged and the insulation feed device is inactive. The insulation gun of the second embodiment also includes a hollow barrel portion and a handle portion. The handle portion further includes a first switch which is biased in the open position such that when the handle portion is not held by an operator the first switch is open. The first switch of the gun of the second embodiment is connected in both the first control circuit and the second control circuit. Accordingly, when the first switch is open, both the first and second control circuits are open which causes the first clutch associated with the blower and the second clutch associated with the insulation feed device to be disengaged rendering both the blower and the insulation feed device inactive. The insulation gun of the second embodiment also includes a second switch which is connected in the second control circuit which controls the second clutch associated with the insulation feed device. The second switch has a first closed position in which the second control circuit is closed thus causing the insulation feed device to operate and a second open position in which the second control circuit is open thus causing the insulation feed system to not operate. Accordingly, in this arrangement, the first control circuit controlling the blower includes the first switch and the second switch in series while the second control circuit includes just the second switch. Thus, the second switch may be opened to shut down the insulation feed device while the first switch is closed to activate the blower. This will result in the gun receiving a flow of air without insulation or will cause the air box, hose and gun to be substantially cleared of remaining insulation. When both switches are closed, both the insulation feed device and the blower are activated so that air blown insulation is delivered to the gun. When the first switch is open, neither the insulation feed device or the blower operate.

DETAILED DESCRIPTION

Figure 1A:
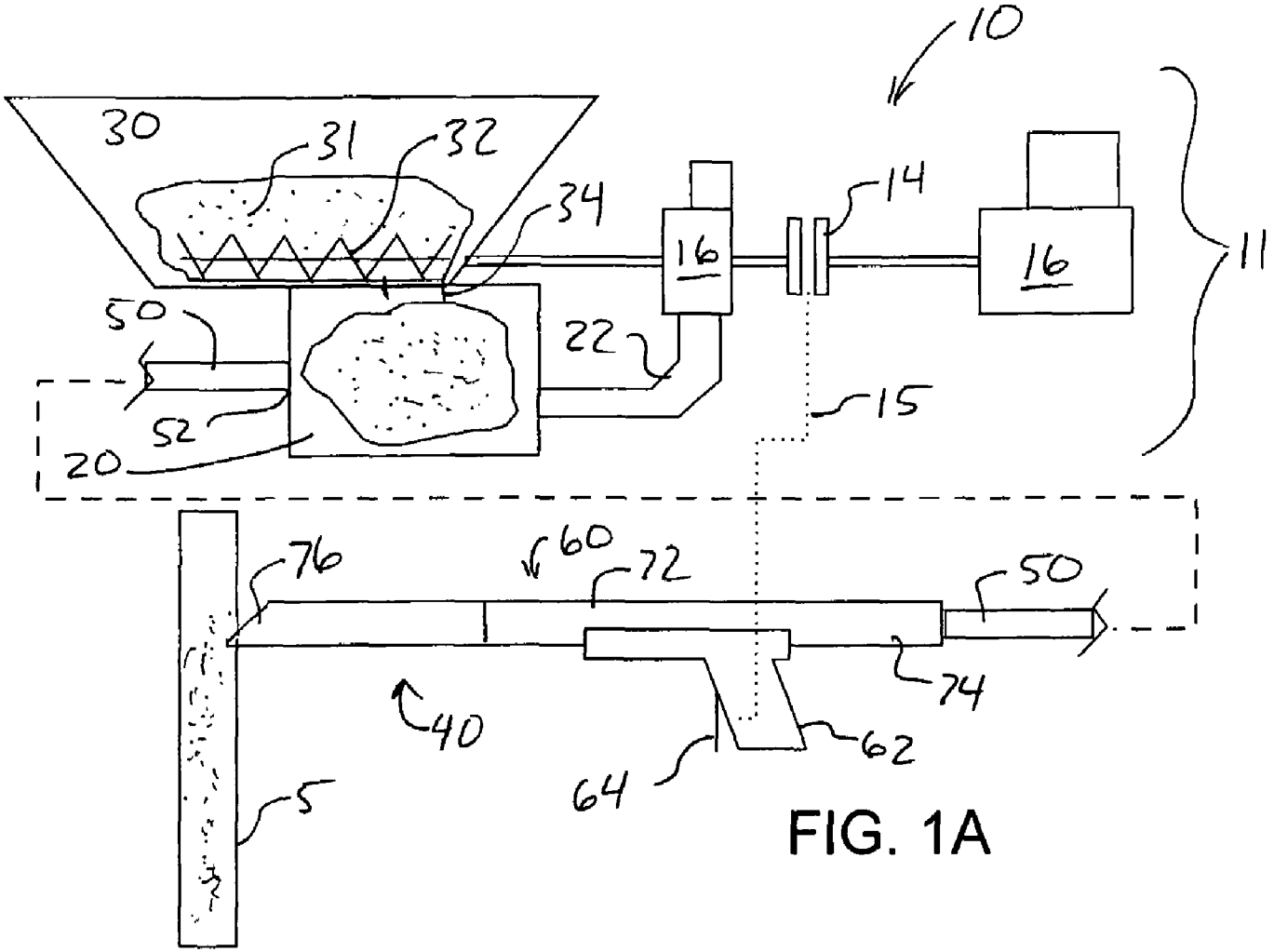
FIG. 1A is a schematic showing a first embodiment of the system for applying insulation.

Referring to the drawings, FIG. 1A schematically illustrates a first embodiment of an improved insulation delivery system 10 for applying loose fill insulation. System 10 generally includes an insulation feed portion 11 and an insulation gun 60. An insulation gun 60 is used to direct loose fill insulation into an insulation space 5. Insulation space 5 may generally include a space above a horizontal surface such as may be found in an attic, or, as shown in FIG. 1A, space 5 may consist of a vertical space disposed between wall frame studs which is enclosed with retaining mesh for retaining loose fill insulation as is well known by those skilled in the art. As will be described in greater detail below, the distal end of insulation gun is preferably pointed for penetrating retaining mesh prior to injecting loose fill insulation.

As shown in FIG. 1A, insulation feed portion 11 includes a blower 12, a motor 16, a blower clutch 14, an insulation hopper 30, an insulation feed device 32, an air box 20 and an insulation hose 50. Blower 12 is connected to a motor 16 through blower clutch 14 which engages or disengages blower 12 with motor 16. An air duct 22 connects blower 12 with an air box 20. Insulation hopper 30 holds dry, loose fill insulation 31. Insulation feed device 32 which is also powered by motor 16 feeds loose fill insulation from hopper 30 through port 34 into air box 20. Insulation hose 50 has a proximate end 52 which is connected to air box 20. When feed device 32 and blower 12 are operating, loose fill insulation 31 and air mix within air box 20 and escape together as a stream of air and insulation through insulation hose 50.

Insulation delivery system 10 further includes an insulation gun 60. Insulation gun 60 is a hand held unit for controlling and directing the application of insulation. Insulation gun 60 includes a handle portion 62 and a barrel portion 72. Barrel portion 72 further comprises a proximate portion 74 which attaches directly to handle portion 62 and a distal portion 76 which connects with proximate portion 74. Handle portion 62 includes a switch 64 which is connected with a blower control circuit 15. Blower control circuit 15 is associated with blower clutch 14 such that blower clutch 14 is engaged when blower control circuit 15 is closed and such that blower clutch 14 is disengaged when blower control circuit 15 circuit is open. Switch 64 is preferably positioned on handle portion 62 such that handle portion 62 must be grasped by an operator in order to close switch 64. Switch 64 is connected within blower control circuit 15 such that when switch 64 is open blower control circuit 15 is open and blower clutch 14 is disengaged and such that when switch 64 is closed, blower control circuit 15 is closed and blower clutch 14 is engaged. Accordingly when an operator grasps handle portion 62, blower clutch 14 is engaged and blower 12 and insulation feed device 32 operate to supply a stream of air and insulation to insulation gun 60. Conversely, when an operator releases handle portion 62, blower clutch 14 is disengaged and blower 12 and insulation feed device 32 cease operation such that no air and insulation are supplied to gun 60.

Figure 2A:
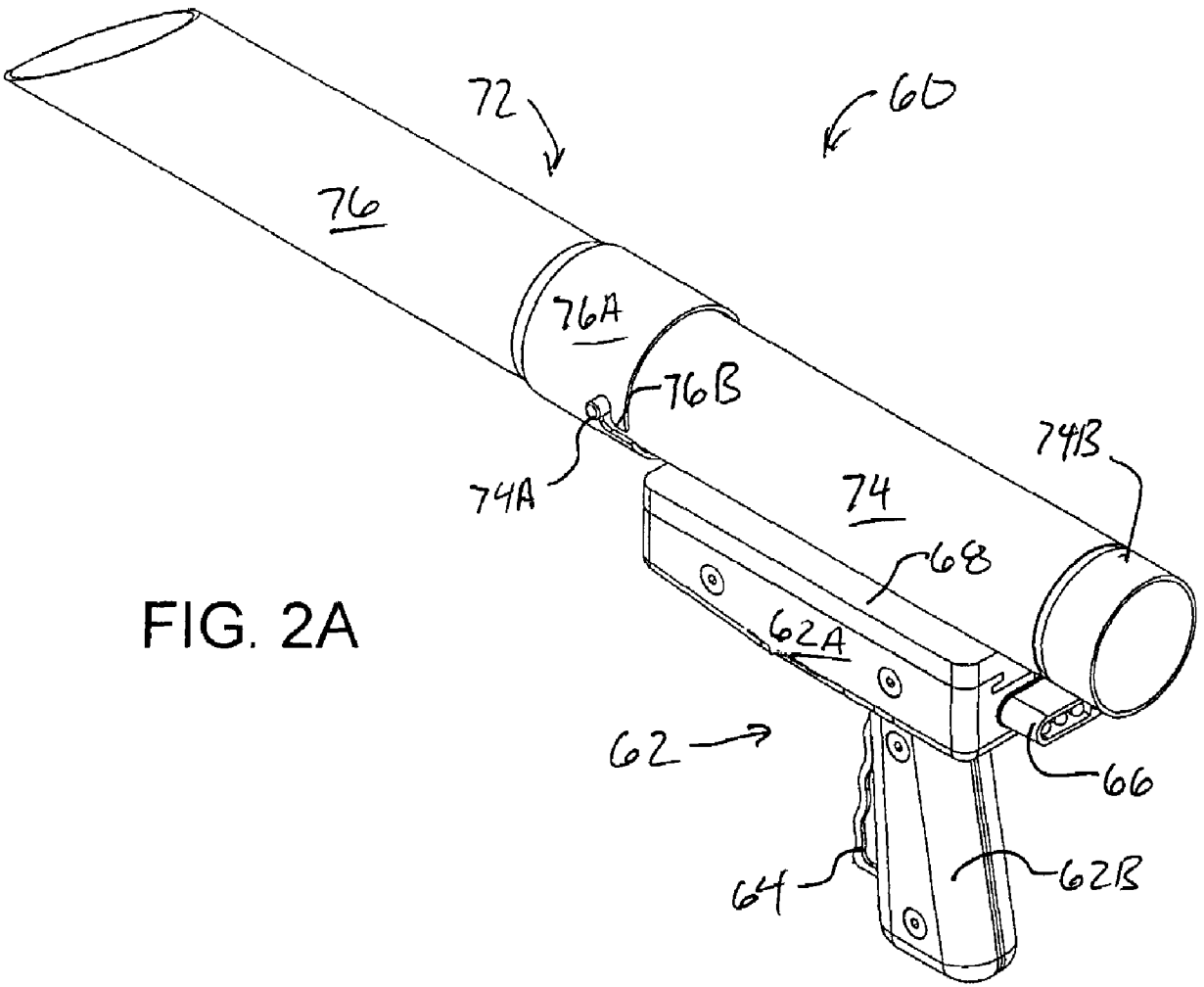
FIG. 2A is a perspective view of an insulation gun for use in the first embodiment system of the present invention.
Figure 2B:
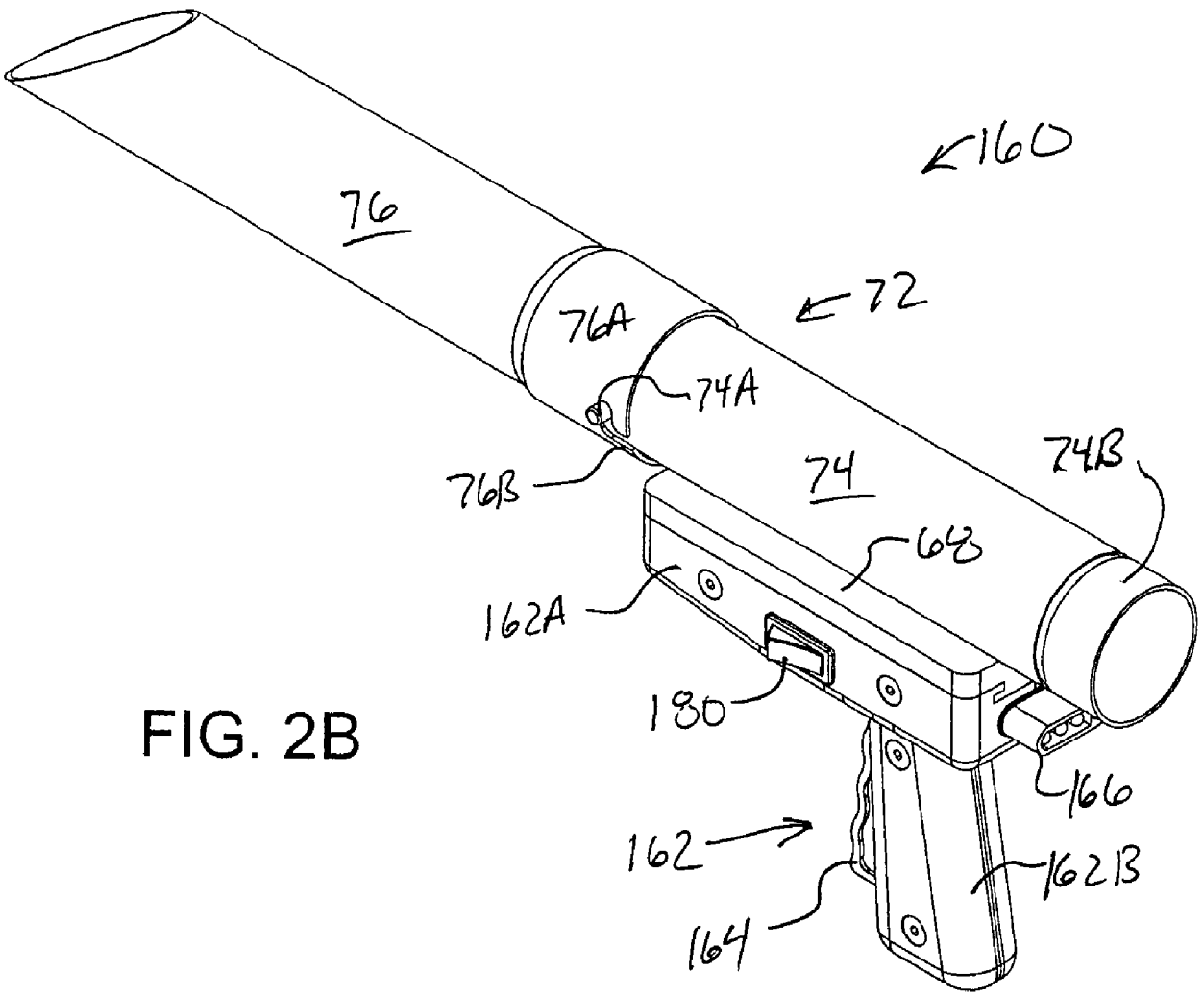
FIG. 2B is a perspective view of an insulation gun for use in the second embodiment system of the present invention.
Figure 3A:
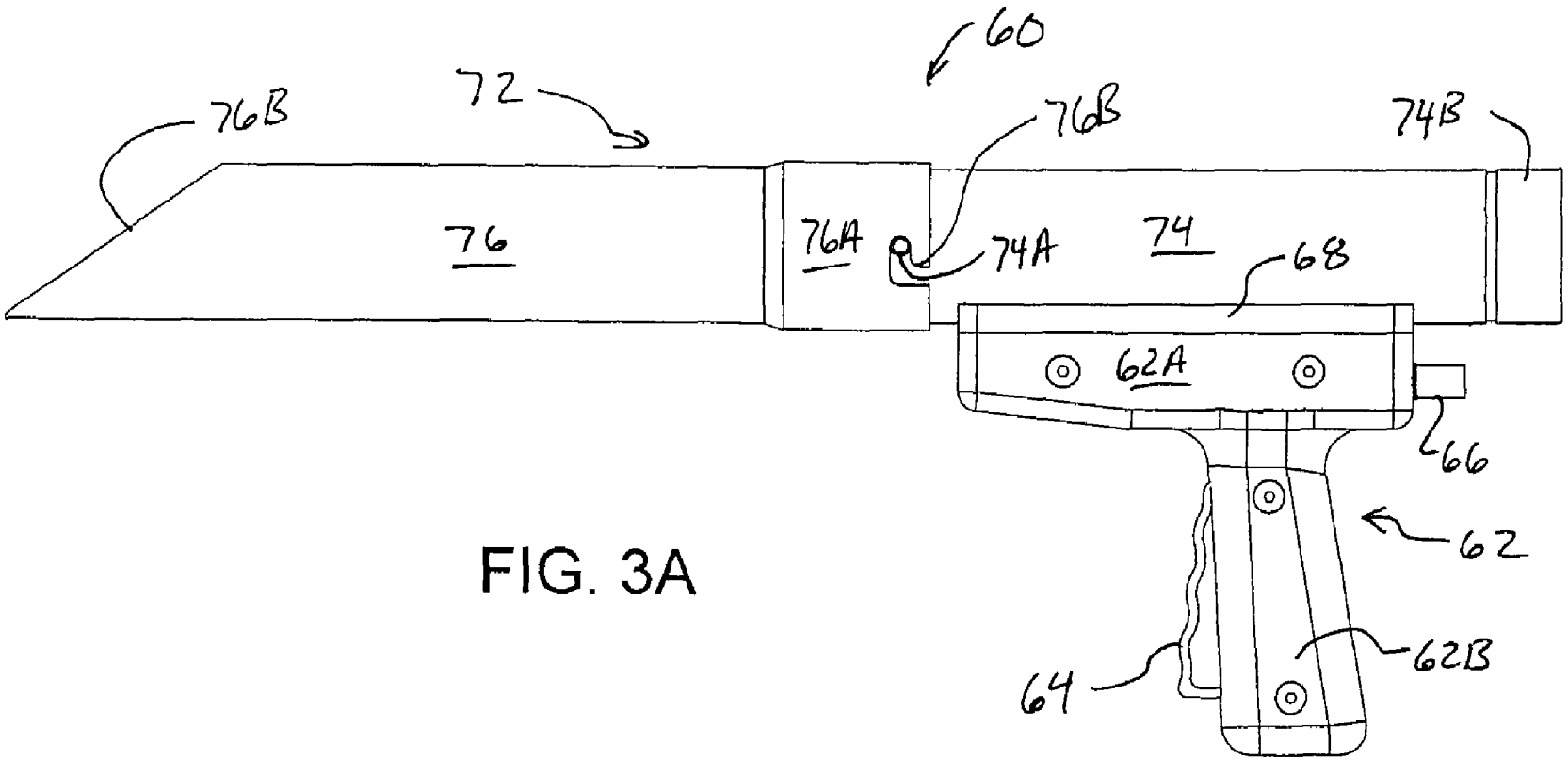
FIG. 3A is a side view of an insulation gun for use in the first embodiment system of the present invention.
Figure 3B:
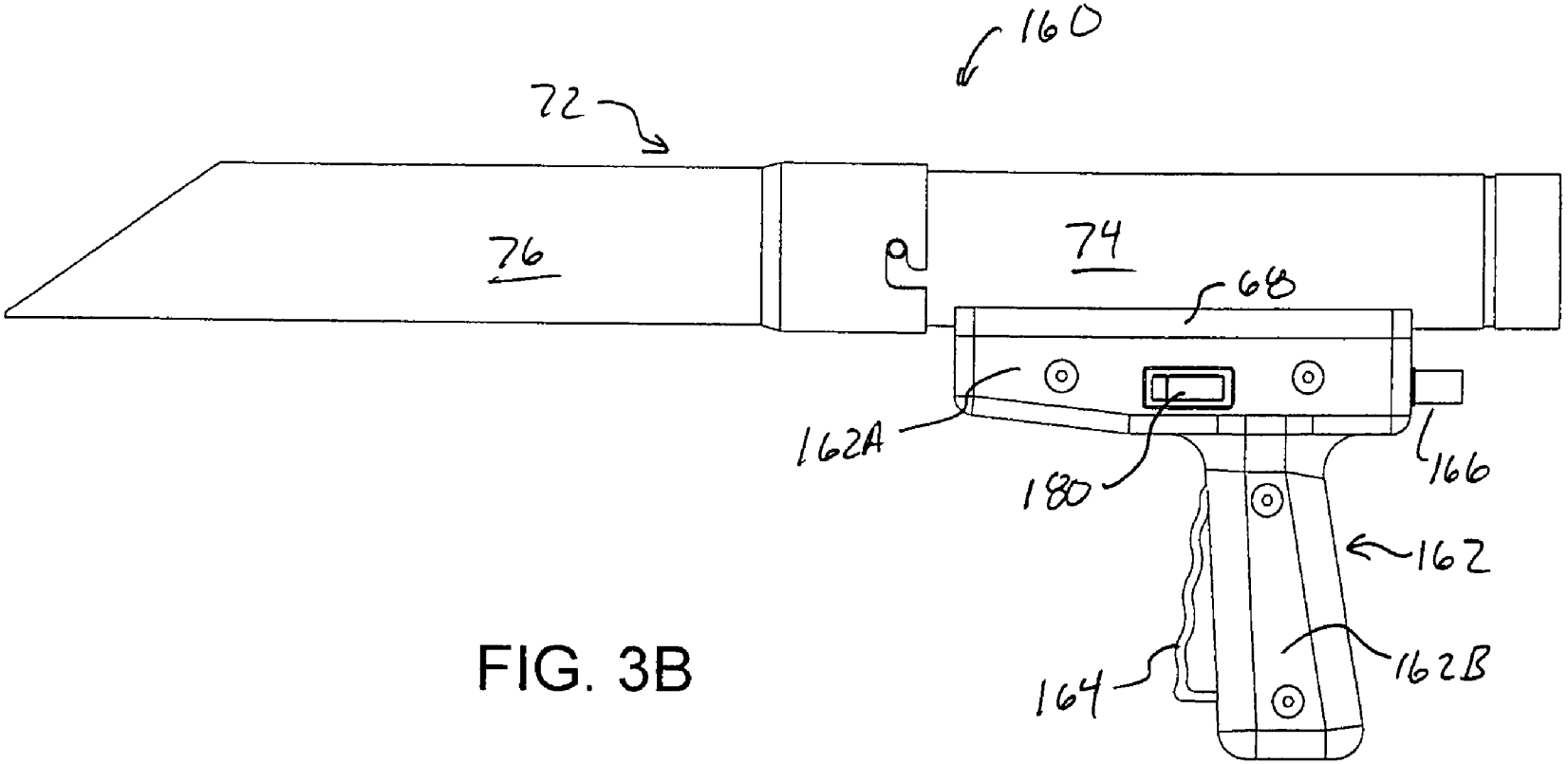
FIG. 3B is a side view of an insulation gun for use in the second embodiment system of the present invention.
Figure 4A:
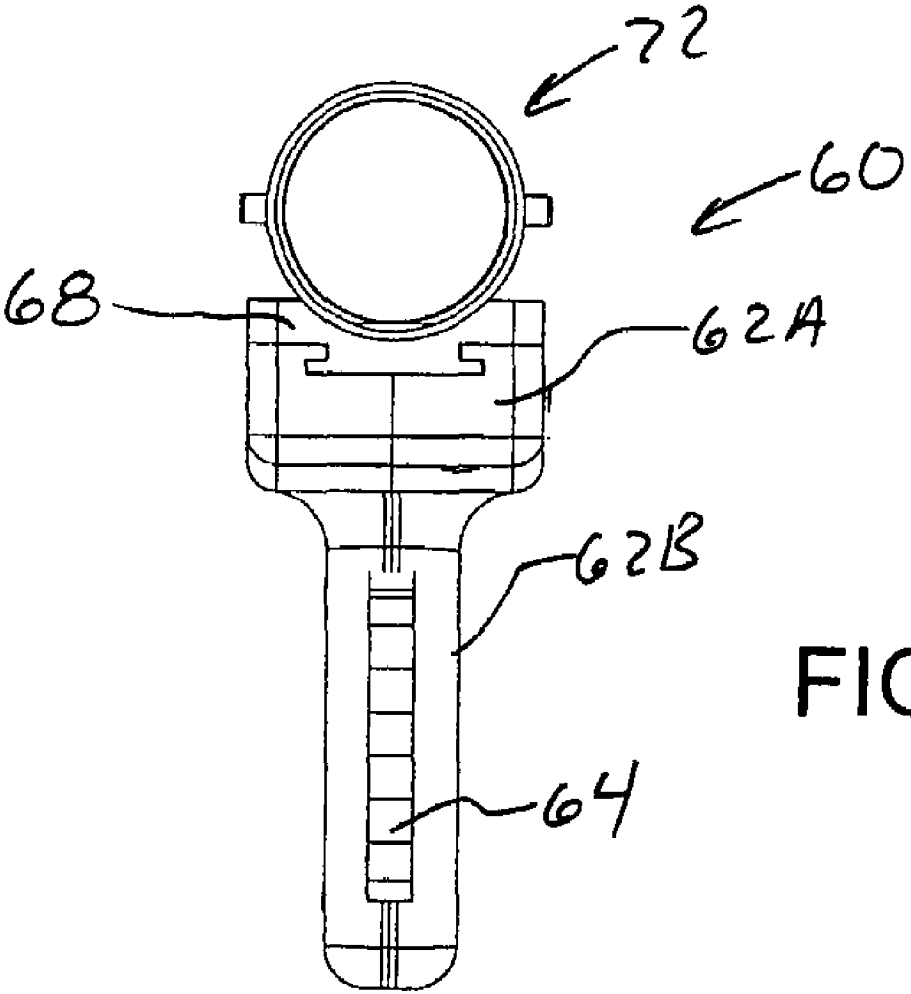
FIG. 4A is an end view of an insulation gun for use in the first embodiment system of the present invention.
Figure 4B:
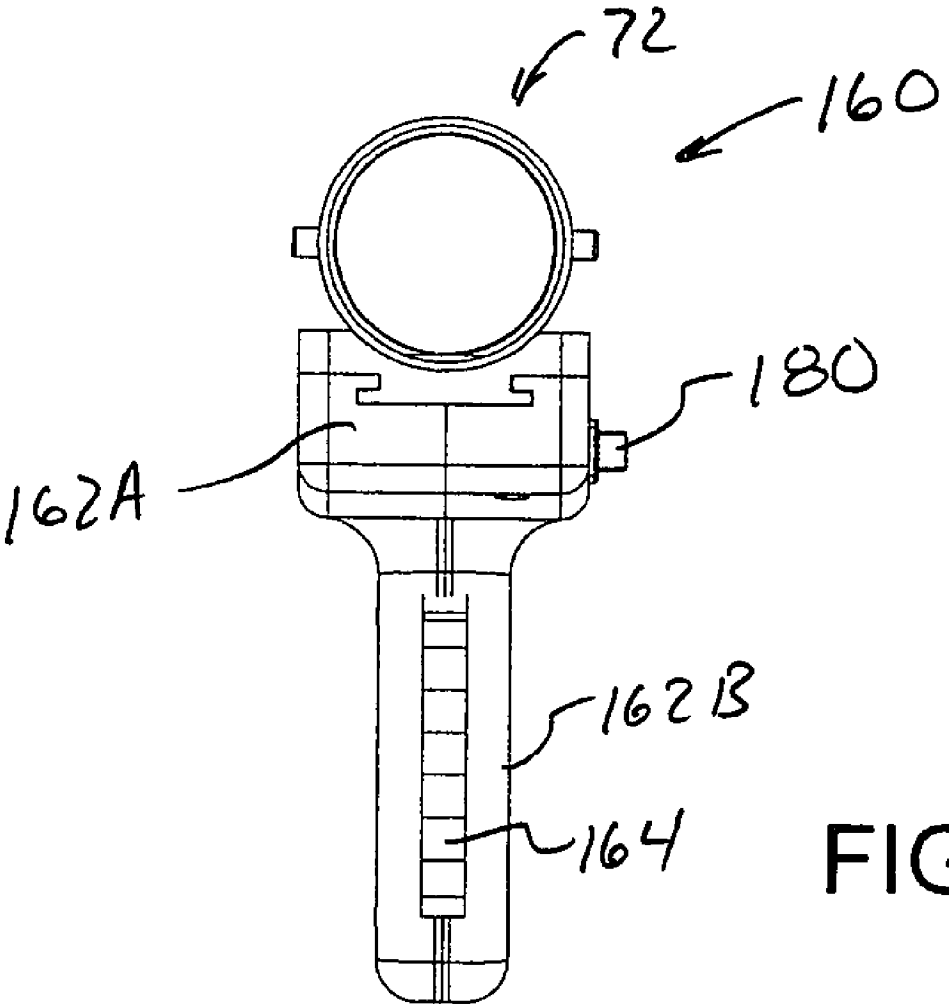
FIG. 4B is an end view of an insulation gun for use in the second embodiment system of the present invention.
Figure 5A:
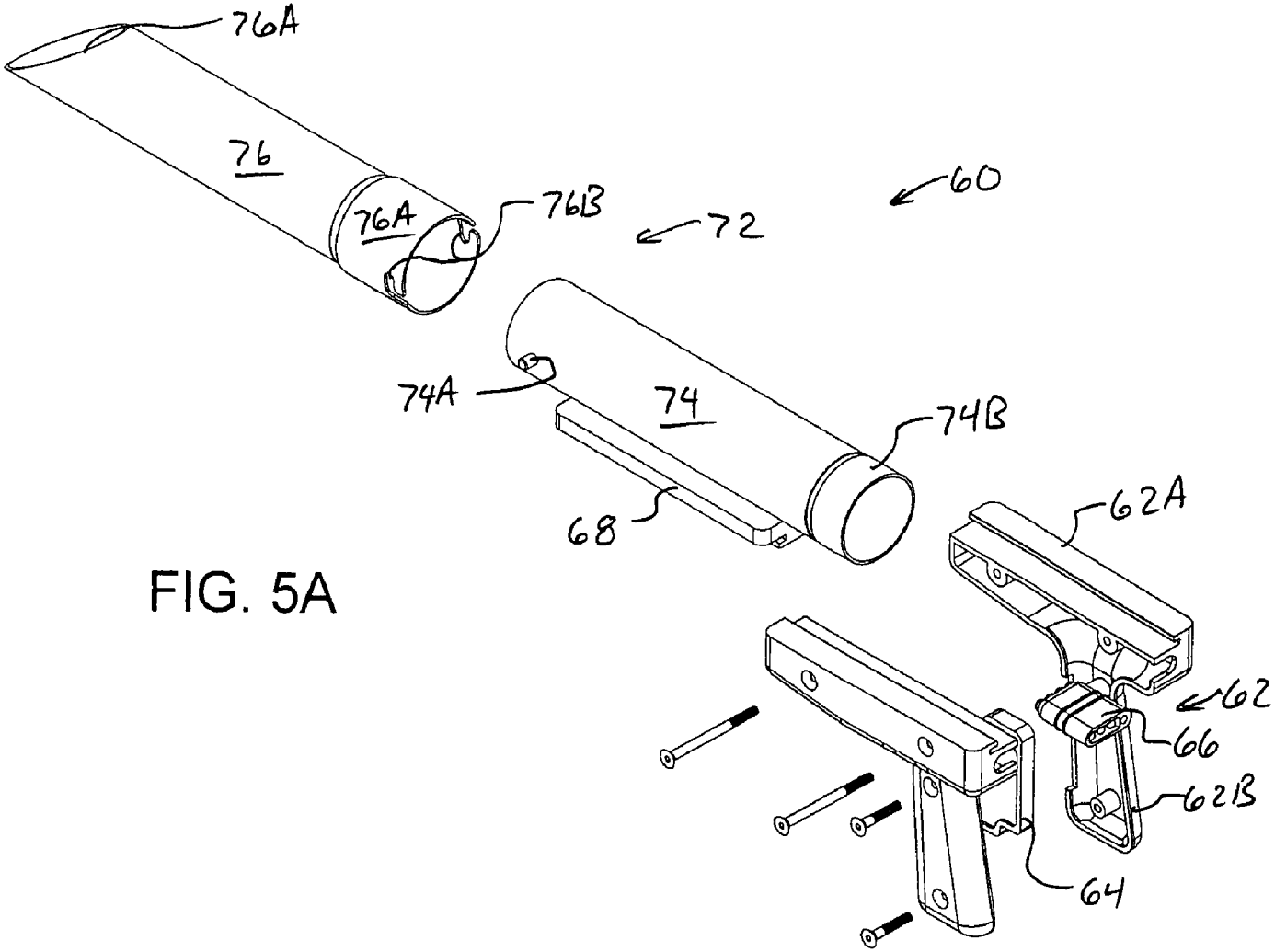
FIG. 5A is an exploded perspective view of an insulation gun for use in the first embodiment system of the present invention.
Figure 5B:
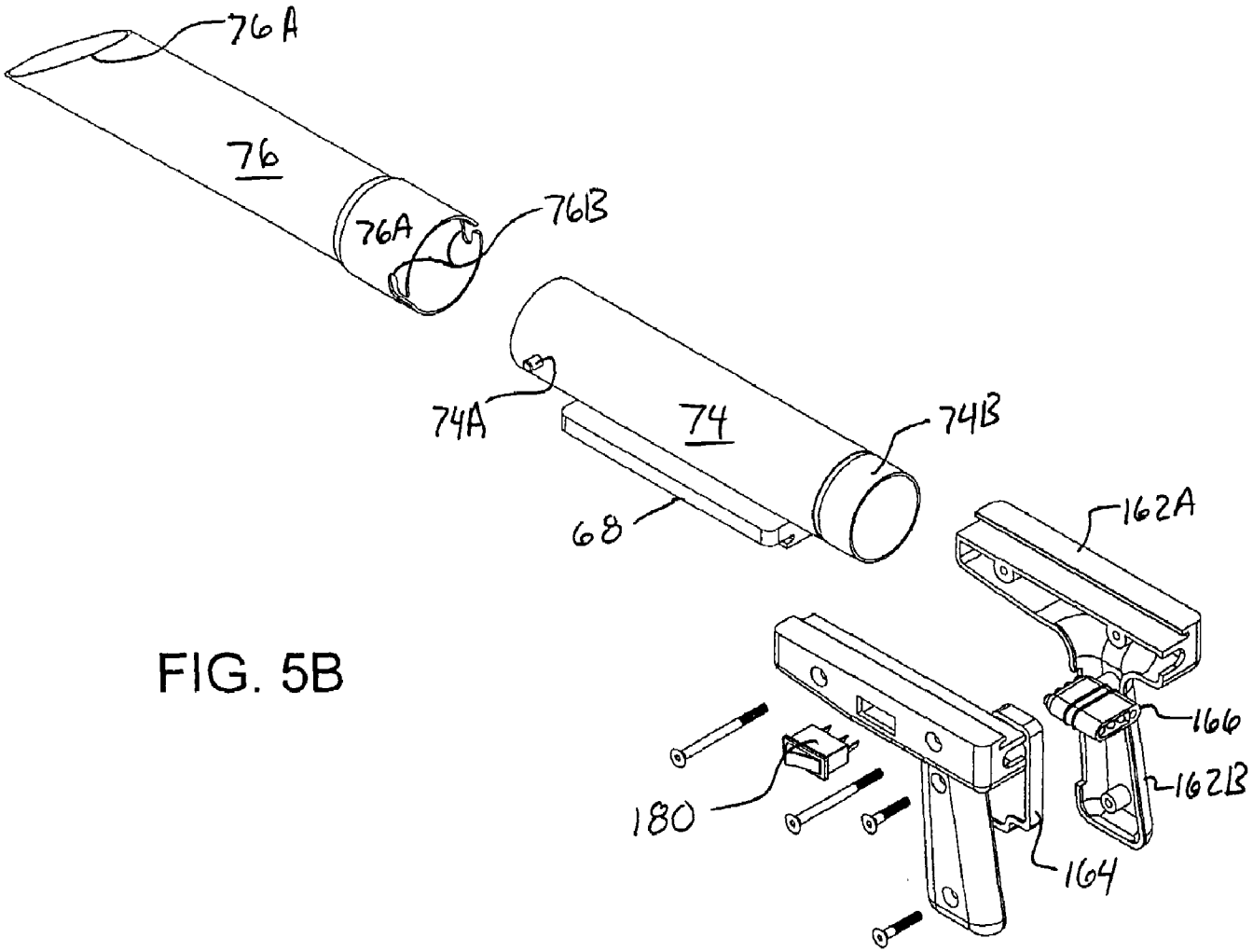
FIG. 5B is an exploded perspective view of an insulation gun for use in the second embodiment system of the present invention.
Figure 6:
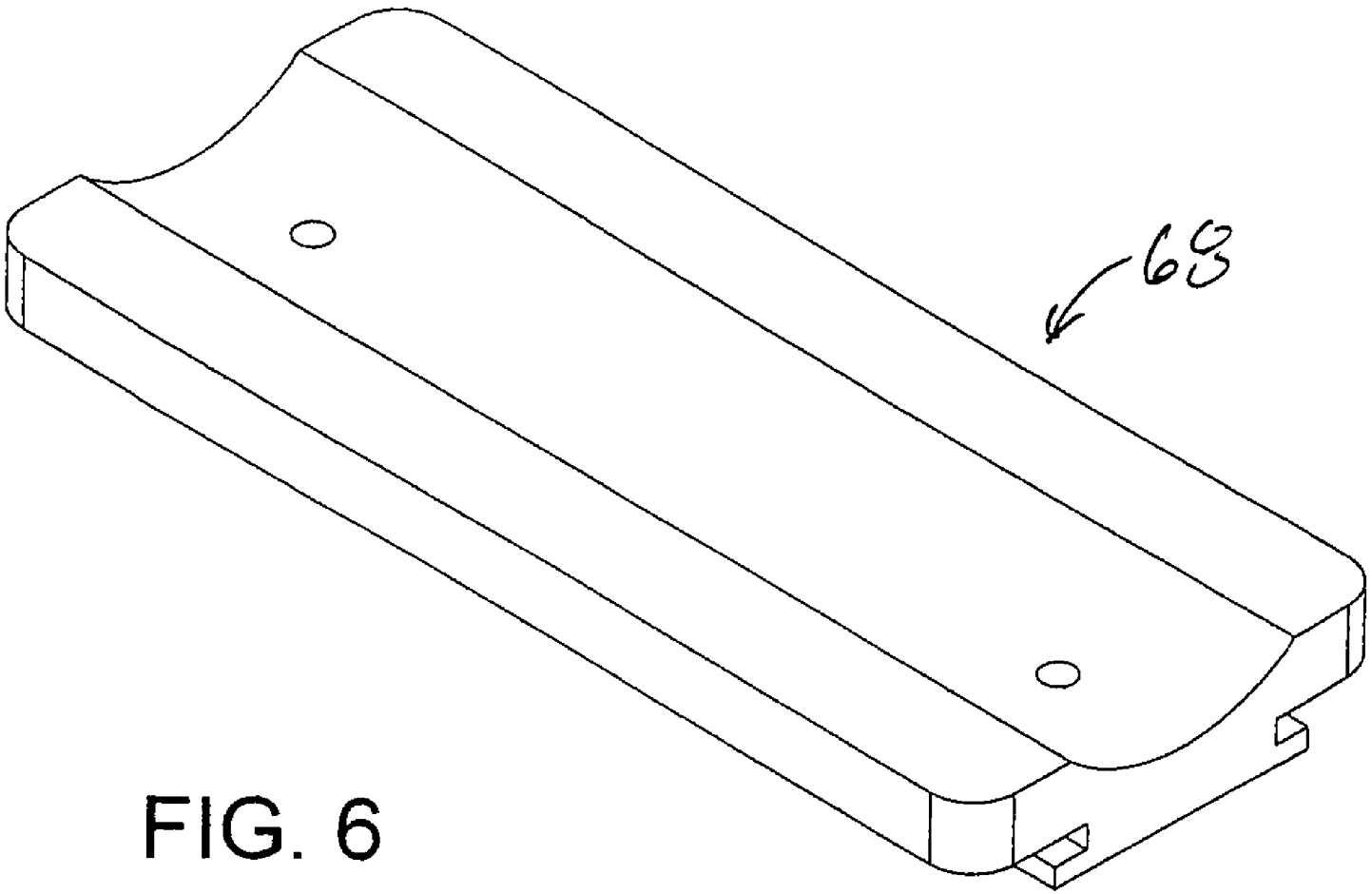
FIG. 6 is a perspective view of a barrel attachment fitting for an insulation.

FIGS. 2A, 3A, 4A, 5A and 6 provide detailed views of insulation gun 60. Insulation gun 60 is adapted for use in the first embodiment of the insulation system 10 diagrammed in FIG. 1A. As can be seen in FIG. 2A, insulation gun 60 includes a barrel portion 72 and a handle portion 62. Barrel portion 72 further includes a proximate portion 74 and a distal portion 76. Proximate portion 74 is mounted to handle portion 62 by a barrel fitting 68 which is shown in greater detail in FIG. 6. The forward end of distal portion 76 is tapered at a sharp angle for penetrating insulation retaining fabric which encloses spaces between wall studs. Distal portion 76 has a coupling portion 76A for engaging the forward end of proximate portion 74. Coupling portion includes a slot 76B for receiving a retaining pin 74B fixed to the forward end of distal portion 74. This arrangement allows for the substitution of various distal portions having varying lengths and shapes. For example, a much longer distal portion may be used to inject insulation at an elevated injection point for a ten or twelve foot wall. A shorter distal portion may be appropriate for work in narrow or confined spaces. The rear end of proximate portion 74 has a coupling portion 74B for coupling with the forward end of insulation hose 50 shown in FIG. 1A.

As noted above, the forward end of distal portion 76 is tapered at a sharp angle for penetrating insulation retaining fabric. Insulation retaining fabric generally comprises a loosely woven fibers which can be easily penetrated as the forward end of distal portion 76 passes into the space. Thus the forward end of distal portion 76 acts as a means for injecting loose fill insulation into a space enclosed by insulation retaining fabric.

Handle portion 62 includes a stock portion 62A and a grip portion 62B. Stock portion 62A is adapted to receive barrel fitting 68. Stock portion 62A includes control circuit coupling 66 for making a connection with blower control circuit 15 shown in FIG. 1A. Grip portion 62B includes a switch 64 which is preferably spring biased in an open position. When grip portion 62B is grasped by an operator, switch 64 is closed thus causing blower control circuit 15 to be closed. Thus, switch 64 functions as a "dead man" switch so that blower control circuit 15 is opened when an operator lets go of grip portion 62B. Yet an operator holding insulation gun 60 may selectively release pressure from switch 64 to stop operation of blower 12.

An operator using insulation delivery system 10 would perform the following steps: 1. Fill insulation hopper 30 with loose fill insulation 31. 2. Activate motor 16. 3. Position insulation gun 60 to penetrate or locate within an insulation space 5. 4. Close switch 64 and open switch 64 as needed to control the flow of loose fill insulation into insulation space 5.

Figure 1B:
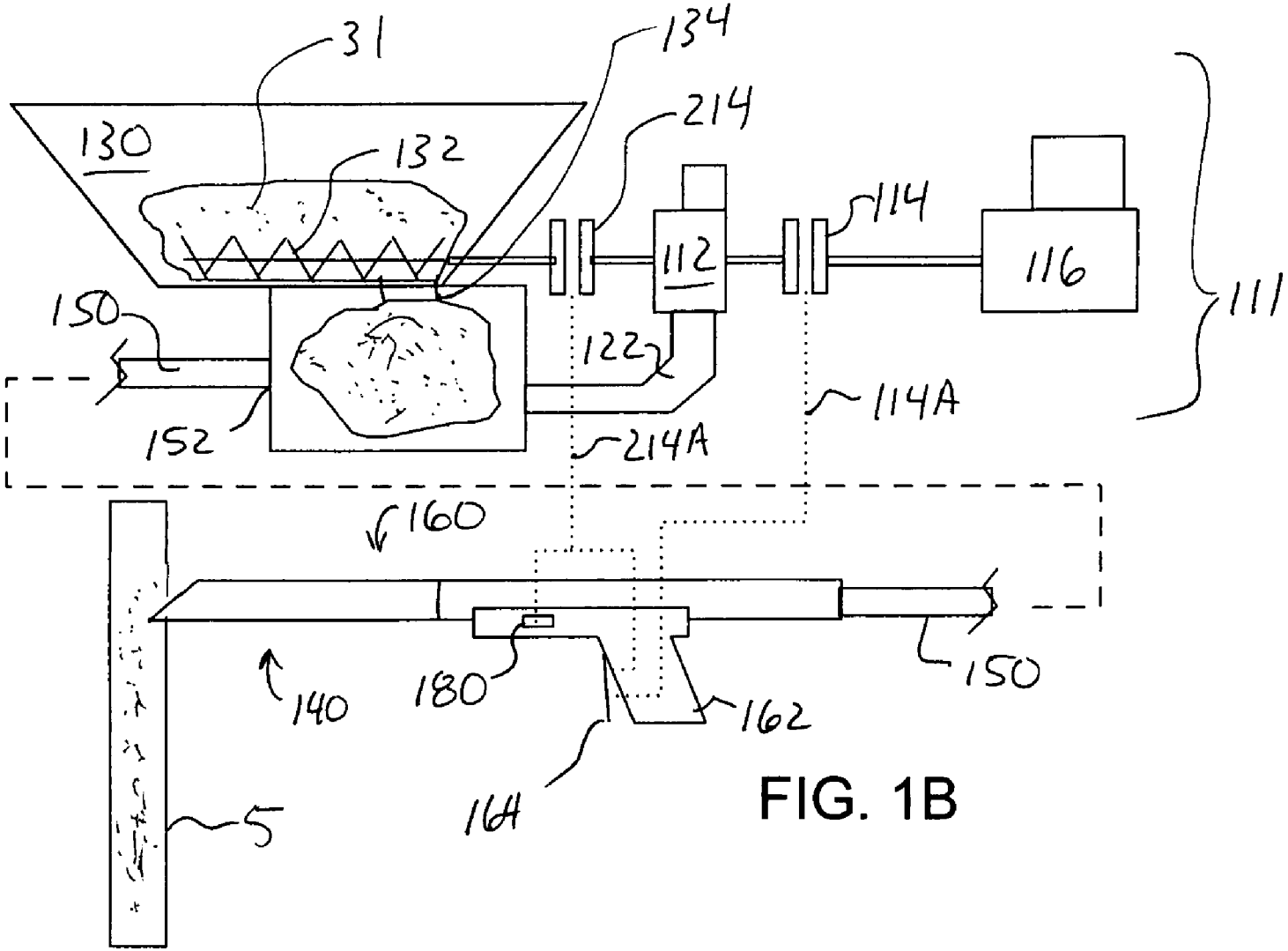
FIG. 1B is a schematic showing a second embodiment of the system for applying insulation.

Referring to the drawings, FIG. 1B schematically illustrates a second embodiment of an improved insulation delivery system 100 for applying insulation. System 100 generally includes an insulation feed portion 111 and an insulation gun 160. As with insulation delivery system 10, insulation gun 160 is used to control the flow and application of loose fill application.

Improved insulation delivery system 100 is shown schematically in FIG. 1B. Insulation delivery system 100 is similar to insulation system 10 with the exception of a second clutch 214 for controlling insulation feed device 132 is interposed between a motor 116 (and a blower 112) and insulation feed device 132 and a second control circuit 214A is added for controlling insulation feed clutch 214. Thus, the clutch controlling blower 112, in the second system should be referred to as a first clutch 114 and the circuit controlling first clutch 114 is now referred to as first control circuit 114A. Insulation delivery system 100 further includes an insulation gun 160 which differs in some respects from insulation gun 60 of delivery system 10. Insulation gun 160 includes a modified handle portion 162. Handle portion 162 includes a first switch 164 which is connected with both the blower control circuit 114A and insulation feed control circuit 214A such that first switch 164 must be closed in order for either of insulation feed device 132 or blower 112 to operate. A second switch 180 is located on a stock portion 162A of handle portion 162. Second switch 180 is connected to second control circuit 214A such that when second switch 180 is closed, second clutch 214 controlling insulation feed device 132 is engaged thus activating insulation feed device 132 if first switch 164 is also closed and such that when second switch 180 is open, second clutch 214 is disengaged thus deactivating insulation feed device 132. When second switch 180 is open, an operator can close first switch 164 to activate blower 112 without activating insulation feed device 132. This will cause most of any remaining insulation in air box 152 to clear out and then, after air box 152 is generally cleared of insulation, air will flow to flow to gun 160.

An operator using insulation delivery system 100 would perform the following steps: 1. Fill insulation hopper 130 with loose fill insulation 31. 2. Activate motor 116. 3. Position insulation gun 160 to penetrate or locate within an insulation space 5. 4. To provide a flow of insulation and air to insulation gun 160, close second switch 180 and close first switch 164. 5. To provide a flow of air without insulation to insulation gun 160, open second switch 180 and close first switch 164. 5. To stop the flow of both insulation and air to insulation gun 160, open first switch 164.

FIGS. 2B, 3B, 4B, 5B and 6 provide detailed views of insulation gun 160. Insulation gun 160 is adapted for use in the second embodiment of the insulation system 100 diagrammed in FIG. 1B. Insulation gun 160 is generally similar to insulation gun 60 except that handle portion 62 is replaced by a handle portion 162 adapted for use with blower control circuit 114A and insulation feed control circuit 214A. Accordingly handle portion 162 includes a stock portion 162A and a handle portion 162B. Stock portion 162A is adapted to receive barrel fitting 68 for mounting barrel portion 72. Stock portion 162A includes control circuit coupling 166 for making a connection with blower control circuit 114A and insulation feed control circuit 214A shown in FIG. 1B. Handle portion 162B includes a first switch 164 which is preferably spring biased in an open position. When handle portion 162B is grasped by an operator, first switch 164 is closed thus causing first circuit 114A controlling first clutch 114 and second circuit 214A controlling second clutch 214 to be closed. Thus, switch 164 functions as a "dead man" switch so that first circuit 114A and second circuit 214A are opened, thus deactivating blower 112 and insulation feed device 132 when an operator lets go of handle portion 162B. A second switch 180 is integrated in stock portion 162A for opening and closing second circuit 214A controlling second clutch 214. Accordingly, first switch 164 and second switch 180 are in series in second circuit 214A. This creates a second condition needed for closing second circuit 214A, namely the closing of second switch 180. Accordingly, second circuit 214A is closed and insulation feed device 132 operates when both first switch 164 and second switch 180 are closed. When second switch 180 is open, first circuit 114A can be closed by first switch 164 to exclusively operate blower 112 and clear air box a53 of most remaining insulation and then to supply mostly air without insulation to insulation gun 160.

It is to be understood that while certain forms of this invention have been illustrated and described, it is not limited thereto, except in so far as such limitations are included in the following claims and allowable equivalents thereof.

The invention claimed is:

1. An insulation gun for in combination with a loose fill insulation supply apparatus including, a blower, a first clutch controlled by a first control circuit for engaging or disengaging a motor with said blower, an air box in communication with said blower, an insulation feed device for transferring said loose fill insulation to said air box, a second clutch controlled by a second control circuit for engaging or disengaging said motor with said insulation feed device and an insulation hose having a proximate end in communication with said air box and opposite distal end, said insulation hose for carrying said loose fill insulation material in an air stream away from said air box, said insulation gun comprising:

(a) a hollow barrel for communication with said distal end of said insulation hose, (b) a first switch connected in said first clutch control circuit and also connected in said second clutch control circuit, said first switch operating between an open position in which said first and second clutch control circuits are open thus causing disengagement of said first and second clutches such that power is not provided in said blower and said insulation feed device and a closed position in which said first and second clutch control circuits are closed thus causing engagement of said first and second clutches such that power is provided to said blower and said insulation feed device, (c) a second switch connected in said second control circuit said second switch operating between an open position in which said second clutch control circuit is open thus causing disengagement of said second clutch such that power is not provided to said insulation feed device and a closed position in which said second clutch control circuit is closed causing engagement of said second clutch such that power is provided to said insulation feed device if said first switch is also closed, whereby an operator using said insulation gun activates said insulation feed device and said blower and thus causes loose fill insulation to flow into an insulation space by closing said first switch and said second switch and whereby an operator deactivates said insulation feed device while continuing to activate said blower by closing said first switch and opening said second switch or whereby an operator deactivates said insulation feed device and said blower by opening said first switch.

2. The insulation gun of claim 1, further comprising;

a handle portion fixed to said barrel adapted for grasping by an operator and said first switch is normally open and is positioned on said handle portion such that said first switch is closed when said handle portion is grasped by an operator, whereby when an operator is not holding said insulation gun, said first switch is open and said first and second clutches are disengaged.

3. The insulation gun of claim 1, further comprising;

a handle portion fixed to said barrel adapted for grasping by an operator and said first switch is normally open and is positioned on said handle portion such that said first switch is closed when said handle portion is grasped by an operator, whereby when an operator is not holding said insulation gun, said first switch is open and said first and second clutches are disengaged, and, and wherein said second switch is a toggle switch operable between an open position and a closed position.

4. The insulation gun of claim 1, further comprising;

a handle portion fixed to said barrel and said handle portion further includes a grip portion extending from said handle portion adapted for grasping by an operator and said first switch is normally open and is positioned on said grip portion such that said first switch is closed when said grip portion is grasped by an operator, whereby when an operator is not holding said insulation gun, said first switch is open and said first and second clutches are disengaged.

5. The insulation gun of claim 1, further comprising;

a handle portion fixed to said barrel and said handle portion further includes a grip portion extending from said handle portion adapted for grasping by an operator and said first switch is normally open and is positioned on said grip portion such that said first switch is closed when said handle portion is grasped by an operator, whereby when an operator is not holding said insulation gun, said first switch is open and said first and second clutches are disengaged, and wherein, said second switch is a toggle switch operable between an open position and a closed position and is positioned on said handle portion generally proximate to said grip portion.

* * * * *